US009133561B2

(12) United States Patent
Shigeta

(10) Patent No.: US 9,133,561 B2
(45) Date of Patent: Sep. 15, 2015

(54) CYLINDER PLATING METHOD AND DEVICE

(75) Inventor: Tatsuo Shigeta, Kashiwa (JP)

(73) Assignee: THINK LABORATORY CO., LTD., Chiba (JP)

( * ) Notice: Subject to any disclaimer, the term of this patent is extended or adjusted under 35 U.S.C. 154(b) by 179 days.

(21) Appl. No.: 13/820,641

(22) PCT Filed: Sep. 27, 2011

(86) PCT No.: PCT/JP2011/071961

§ 371 (c)(1),
(2), (4) Date: Mar. 4, 2013

(87) PCT Pub. No.: WO2012/043514

PCT Pub. Date: Apr. 5, 2012

(65) Prior Publication Data

US 2013/0161196 A1 Jun. 27, 2013

(30) Foreign Application Priority Data

Sep. 30, 2010 (JP) ..... 2010-220407

(51) Int. Cl.

| | |
|---|---|
| ***C25D 7/04*** | (2006.01) |
| ***B41C 1/18*** | (2006.01) |
| ***C25D 17/12*** | (2006.01) |
| ***C25D 7/06*** | (2006.01) |
| ***C25D 3/38*** | (2006.01) |
| ***C25D 17/00*** | (2006.01) |
| ***C25D 17/06*** | (2006.01) |

(52) U.S. Cl.
CPC ... *C25D 7/04* (2013.01); *B41C 1/18* (2013.01); *C25D 3/38* (2013.01); *C25D 7/0657* (2013.01); *C25D 17/005* (2013.01); *C25D 17/06* (2013.01); *C25D 17/12* (2013.01)

(58) Field of Classification Search
CPC ..... C25D 7/04
USPC ..... 205/151
See application file for complete search history.

(56) References Cited

U.S. PATENT DOCUMENTS

| | | | | |
|---|---|---|---|---|
| 1,918,627 | A * | 7/1933 | Ballard | 204/212 |
| 6,547,936 | B1 * | 4/2003 | Metzger | 204/212 |
| 2008/0121526 | A1 * | 5/2008 | Hsiao et al. | 205/80 |
| 2009/0095633 | A1 * | 4/2009 | Inoue et al. | 205/143 |

FOREIGN PATENT DOCUMENTS

| | | | |
|---|---|---|---|
| CN | 101184870 | A | 5/2008 |
| EP | 1887108 | A1 | 2/2008 |

(Continued)

*Primary Examiner* — Bryan D. Ripa
(74) *Attorney, Agent, or Firm* — McGlew and Tuttle, P.C.

(57) ABSTRACT

Provided are a plating method and a plating apparatus for a cylinder, which are capable of forming a plating layer having a uniform thickness in a technology of plating a cylinder, effectively preventing current concentration in cylinder end portions when being combined with a plating technology using divided insoluble electrodes, and performing plating with a more uniform thickness over the full length of a cylinder without generating defects such as rashes and pits irrespective of the size of the cylinder. The insoluble electrode has a shape in which a lower part thereof is curved inward, and is capable of rotating about an upper end thereof. Further, a thickness of a plating layer on an outer peripheral surface of the cylinder is adjusted by controlling an interval of closeness to the cylinder.

15 Claims, 7 Drawing Sheets

(56) References Cited

FOREIGN PATENT DOCUMENTS

| | | | |
|---|---|---|---|
| JP | S57-36995 | B | 8/1982 |
| JP | H0198170 | U | 6/1989 |
| JP | H11-61488 | A | 3/1999 |
| JP | 11-117095 | A | 4/1999 |
| JP | 2001-81592 | A | 3/2001 |
| JP | 2005-29876 | A | 2/2005 |
| JP | 2005-133139 | A | 5/2005 |
| JP | 2007-224321 | A | 9/2007 |
| JP | 2008-150675 | A | 7/2008 |
| KR | 10-2007-0118694 | A | 12/2007 |
| WO | 2006-126518 | A1 | 11/2006 |

* cited by examiner

CYLINDER PLATING METHOD AND DEVICE

TECHNICAL FIELD

The present invention relates to a plating method and a plating apparatus for a cylinder, which are configured to perform plating using an insoluble electrode as a plating material for forming a printing surface, for example, copper plating or chromium plating, on an outer peripheral surface of a long cylinder, for example, a hollow cylindrical gravure cylinder (also called a plate-making roll) used for gravure printing. In particular, the present invention relates to a plating method and a plating apparatus for a cylinder, which are capable of adjusting a thickness of a plating layer on an outer peripheral surface of the cylinder through use of an insoluble electrode including a lower part curved inward.

BACKGROUND ART

In gravure printing, minute concave portions (cells) are formed on a gravure cylinder in accordance with plate-making information to produce a printing surface, and the cells are filled with ink so that the ink is transferred to an object to be printed. In a general gravure cylinder, a cylindrical iron core or aluminum core (hollow roll) is used as a base, a plurality of layers such as an underlying layer and a separation layer are formed on an outer peripheral surface of the base, and a copper plating layer (plating material) for forming a printing surface is formed on the plurality of layers. Then, cells are formed on the copper plating layer in accordance with plate-making information by a laser exposure apparatus, and thereafter, the resultant base is plated with chromium or the like for enhancing printing durability of a gravure cylinder. In this manner, plate making (production of a printing surface) is completed.

Conventionally, as a method and apparatus for performing copper plating on an outer peripheral surface of a gravure cylinder, the use of a phosphorus-containing copper ball as a soluble anode is well known. According to the conventional method and apparatus, both ends in a longitudinal direction of a gravure cylinder are held so as to be rotated and energized by a pair of roll chucks, the gravure cylinder is accommodated in a plating bath in which a plating solution is stored while the gravure cylinder is being rotated, and a current with a current density of about 10 to 15 A/dm$^2$ is allowed to flow between the phosphorus-containing copper ball (soluble anode) in the plating solution and the gravure cylinder (cathode), to thereby deposit copper on an outer peripheral surface of the gravure cylinder, which functions as a cathode, with the result that copper plating is performed (for example, see Patent Documents 1 and 2).

However, in general, a phosphorus-containing copper ball used in a copper plating method and apparatus for a gravure cylinder contains 350 to 700 ppm of phosphorus and 2 to 5 ppm of oxygen, and the rest of the ball contains copper and impurities. Due to the impurities contained in the ball inevitably, anode sludge is generated during plating treatment, which causes defects such as rashes (minute protrusions) and pits (pinholes) on the outer peripheral surface of the gravure cylinder. Although there is a phosphorus-containing copper ball of high purity for producing a semiconductor and the like, such a ball is expensive and is not adopted for a gravure cylinder in terms of cost-efficiency. Further, in order to prevent the dissolution amount of a phosphorus-containing copper ball in a copper plating solution from increasing excessively to enhance the copper ion concentration, making it impossible to perform appropriate plating treatment, it is also necessary to dilute the solution by removing a plating solution periodically, thereby adjusting the copper ion concentration appropriately and disposing of a waste liquid. Further, a current is concentrated in the vicinity of both ends of the gravure cylinder, and hence the peripheral surface in the vicinity of both ends is plated thicker than a body portion, with the result that it is necessary to separately perform treatment for obtaining a uniform thickness of plating by follow-up polishing or the like.

On the other hand, in addition to a method using a phosphorus-containing copper ball as a soluble anode, a copper plating method using an insoluble anode is known. As a copper plating method and apparatus for a gravure cylinder using an insoluble anode, for example, a titanium plate coated on the surface with iridium oxide or the like is used as an insoluble anode, a plating bath and a copper dissolution bath are prepared, the copper plating material (e.g., copper oxides or copper carbonates) is dissolved in the dissolution bath, the resultant solution is supplied to a plating solution in the plating bath, and a current is supplied between an insoluble anode and a gravure cylinder forming a cathode. In this manner, copper plating is performed (for example, see Patent Document 3).

According to the above-mentioned method and apparatus, anode sludge is not generated so that defects such as rashes and pits are not caused, but there is still a problem that the peripheral surface in the vicinity of both ends of a gravure cylinder is plated thick. In order to solve this problem, the applicant of the present application has already proposed a copper plating method and apparatus for a gravure cylinder in which an insoluble anode positioned below a gravure cylinder is configured so as to be lifted in a plating bath, and the insoluble anode is brought close to a lower surface of the gravure cylinder with a gap of 5 mm to 30 mm in accordance with gravure cylinders of various sizes, with the result that a current is not concentrated in the vicinity of both ends of the gravure cylinder, plating with a uniform thickness can be performed over the full length of the gravure cylinder, and the concentration of copper and the concentration of sulfuric acid in the plating solution can be adjusted automatically (see Patent Document 4).

Still further, in the above-mentioned proposal, there are the following problems. That is, an insoluble anode is placed directly in the plating solution, and hence the consumption amount of additives such as a brightener and a burn prevention agent is remarkably large. A current density is about 15 to 20 A/dm$^2$ and a voltage is about 10 to 15 V for the purpose of preventing a burn, and hence plating treatment takes a long time, which results in a large power supply cost. The uniformity of a plating thickness is insufficient. The insoluble anode is positioned below the gravure cylinder, and hence visibility and operability are poor. Considering these problems, the applicant of the present application has already proposed a copper plating method and apparatus for a gravure cylinder, in which a hollow cylindrical gravure cylinder is held at both ends in a longitudinal direction and accommodated in a plating bath filled with a copper plating solution, the gravure cylinder is rotated at a predetermined speed and supplied with a current so as to become a cathode, and a pair of anode chambers in the shape of a long box that is vertically installed slidably so as to face both sides of the gravure cylinder in the plating bath and contains insoluble anodes supplied with a current so as to become an anode are brought close to both side surfaces of the gravure cylinder with a predetermined interval to perform copper plating on an outer peripheral surface of the gravure cylinder (Patent Document 5).

According to the above-mentioned proposal, a copper plating method and apparatus for a gravure cylinder that provide good visibility and operability can be provided, in which copper plating with a uniform thickness compared to the conventional example can be performed over the full length of a gravure cylinder without generating defects such as rashes and pits irrespective of the size of the gravure cylinder, the concentration of a copper plating solution can be managed automatically, the consumption amount of additives can be reduced, plating treatment can be performed in a short period of time, and a power supply cost can be reduced. However, from the viewpoint of the uniformity of a thickness of copper plating over the full length of a gravure cylinder 300, the uniformity is not necessarily sufficient, and the following phenomenon has not been solved sufficiently. That is, in the vicinity of both ends of the gravure cylinder 300 (particularly, portions of about 50 mm to 200 mm from both ends), a current is concentrated, and hence, a peripheral surface in the vicinity of each end is plated thicker than a body portion, with a result that a thick plating layer of about 150 μm is formed.

The applicant of the present application has further continued to study extensively, and obtained a new landmark finding that, by dividing an insoluble electrode and adjusting a potential of each divided electrode, the current concentration in cylinder end portions can be prevented effectively. Thus, the applicant of the present application has provided a plating method for a cylinder and an apparatus therefor that provide good visibility and operability, in which copper plating with a more uniform thickness can be performed over the full length of a cylinder without generating defects such as rashes and pits irrespective of the size of the cylinder, the concentration of a copper plating solution can be managed automatically, the consumption amount of additives can be reduced, plating treatment can be performed in a short period of time, a power supply cost can be reduced, and the vicinity of both ends of the cylinder is capable of greatly preventing from being plated thicker than the body portion, to thereby eliminate or simplify treatment for obtaining the uniform thickness of plating, such as follow-up polishing (Patent Document 6).

The above-mentioned plating method for a cylinder is a plating method for a cylinder in which a long cylinder is held at both ends in a longitudinal direction and accommodated in a plating bath filled with a plating solution, the cylinder is rotated at a predetermined speed and supplied with a current so as to become a cathode, and a pair of electrode chambers in the shape of a long box that is vertically installed slidably so as to face both sides of the cylinder in the plating bath and contains insoluble electrodes supplied with a predetermined current are brought close to both side surfaces of the cylinder with a predetermined interval to perform plating on an outer peripheral surface of the cylinder. In this method, the insoluble electrode is divided into a large number of divided electrodes, and the insoluble electrode portions at least corresponding to the vicinity of both ends in a longitudinal direction of the cylinder are respectively divided into at least three divided electrode groups. Each divided electrode group has one or more divided electrodes, and a potential of the divided electrode group is controlled so as to adjust a thickness of a plating layer on the outer peripheral surface of each end of the cylinder (Patent Document 6, claim 1).

Further, the above-mentioned plating apparatus for a cylinder includes a plating bath to be filled with a plating solution, chuck means for holding a long cylinder at both ends in a longitudinal direction so as to be rotated and energized, and accommodating the cylinder in the plating bath, and a pair of electrode chambers in the shape of a long box that is vertically installed slidably so as to face both sides of the cylinder in the plating bath and contains insoluble electrodes supplied with a predetermined current, the electrode chamber being brought close to both side surfaces of the cylinder with a predetermined interval to perform plating on an outer peripheral surface of the cylinder. The insoluble electrode is divided into a large number of divided electrodes, and the insoluble electrode portions at least corresponding to the vicinity of both ends in a longitudinal direction of the cylinder are respectively divided into at least three divided electrode groups. Each divided electrode group has one or more divided electrodes, and a potential of the divided electrode group is controlled so as to adjust a thickness of a plating layer on the outer peripheral surface of each end of the cylinder (Patent Document 6, claim 10).

PRIOR ART DOCUMENTS

Patent Documents

Patent Document 1: JP S57-36995 B
Patent Document 2: JP H11-61488 A
Patent Document 3: JP 2005-29876 A
Patent Document 4: JP 2005-133139 A
Patent Document 5: WO 2006-126518
Patent Document 6: JP 2007-224321 A

SUMMARY OF THE INVENTION

Problem to be Solved by the Invention

According to the plating method and apparatus for a cylinder of the above-mentioned proposal, it is understood that the vicinity of both ends of a cylinder can be greatly prevented from being plated thicker than a body portion to eliminate or simplify treatment for obtaining the uniform thickness of plating, such as follow-up polishing. However, from the viewpoint of obtaining the uniform thickness of a plating layer, such plating method and apparatus cannot be considered to be perfect. The applicant of the present application has continuously searched for a technology capable of forming a plating layer uniform in thickness in a technology of plating a cylinder, and obtained a technical finding that a uniform thickness of a plating layer can be obtained in cylinder plating. Accordingly, the applicant of the present application has achieved the present invention.

The present invention provides a plating method for a cylinder and a plating apparatus therefor, which are capable of forming a plating layer having a uniform thickness in a technology of plating a cylinder, effectively preventing current concentration in cylinder end portions, and performing plating with a more uniform thickness over the full length of a cylinder without generating defects such as rashes and pits irrespective of the size of the cylinder.

Means for Solving Problem

According to the present invention, there is provided a plating method for a cylinder, including: holding a long cylinder at both ends in a longitudinal direction; accommodating the long cylinder in a plating bath filled with a plating solution; energizing the long cylinder so that the long cylinder functions as a cathode while rotating the long cylinder at a predetermined speed; bringing a pair of opposed insoluble electrodes close to both side surfaces of the long cylinder with a predetermined interval, the pair of opposed insoluble electrodes being vertically installed so as to face both the side surfaces of the long cylinder in the plating bath and supplied with a predetermined current; and performing plating on an outer peripheral surface of the long cylinder. The pair of opposed insoluble electrodes has a shape in which a lower part thereof is curved inward, and is capable of rotating about an upper end thereof. A thickness of a plating layer on the outer peripheral surface of the long cylinder is adjusted by controlling an interval of closeness to the long cylinder.

According to the present invention, there is provided a plating apparatus for a cylinder, including: a plating bath to be filled with a plating solution; chuck means for holding a long cylinder at both ends in a longitudinal direction so as to be rotated and energized, and accommodating the long cylinder in the plating bath; and a pair of opposed insoluble electrodes which is vertically installed so as to face both side surfaces of the long cylinder in the plating bath, and is supplied with a predetermined current, the pair of opposed insoluble electrodes being brought close to both the side surfaces of the long cylinder with a predetermined interval to perform plating on an outer peripheral surface of the long cylinder. The pair of opposed insoluble electrodes has a shape in which a lower part thereof is curved inward, and is capable of rotating about an upper end thereof. A thickness of a plating layer on the outer peripheral surface of the long cylinder is adjusted by controlling an interval of closeness to the long cylinder.

In the plating method and the plating apparatus for a cylinder of the present invention, regarding the curved shape of the lower part of the insoluble electrode, the effect is enhanced as long as the lower part is curved inward. However, it is preferred that the lower part have a curved shape so as to conform to the curved outer peripheral surface of the cylinder.

The interval at which the insoluble electrode is brought close to the gravure cylinder side surface is about 1 mm to 50 mm, preferably about 3 mm to 40 mm, most preferably about 5 mm to 30 mm. From the viewpoint of the uniformity of a plating thickness, it is preferred that the insoluble electrode be brought as close to the gravure cylinder side surface as possible. However, when the insoluble electrode is brought too close to the gravure cylinder side surface, the insoluble electrode and the gravure cylinder may come into contact with each other during plating treatment.

A copper plating solution can be used as the plating solution, and a gravure cylinder can be used as the cylinder. Further, it is preferred that the copper plating solution contain copper sulfate, sulfuric acid, chlorine, and an additive. When a gravity of the copper plating solution and a concentration of sulfuric acid are measured, in the case where the gravity is too high, it is preferred to supply water, and in the case where the concentration of sulfuric acid is too high, it is preferred to supply cupric oxide powder. Thus, it is not necessary to perform the conventional periodic maintenance of the copper plating solution and the disposal of a waste liquid. Note that, it is preferred that impurities be removed from the copper plating solution through a filter. Further, a chromium plating solution can also be used as the plating solution so as to perform chromium plating.

Effects of the Invention

According to the present invention, the following remarkable effects can be achieved. That is, in a technology of plating a cylinder, a plating layer having a uniform thickness can be formed. Plating with a more uniform thickness can be performed over the full length of a cylinder without generating defects such as rashes and pits irrespective of the size of the cylinder. The vicinity of both ends of the cylinder is greatly prevented from being plated thicker than a body portion, thereby eliminating or simplifying treatment for obtaining a uniform thickness of plating, such as follow-up polishing. The present invention can be particularly suitably used for plating treatment of a gravure cylinder.

BEST MODES FOR CARRYING OUT THE INVENTION

Hereinafter, an embodiment of the present invention is described with reference to the attached drawings. Illustrated examples are shown for illustrative purposes. Therefore, it is natural that they can be modified variously as long as they do not extend beyond the technical idea of the present invention.

Figure 3:
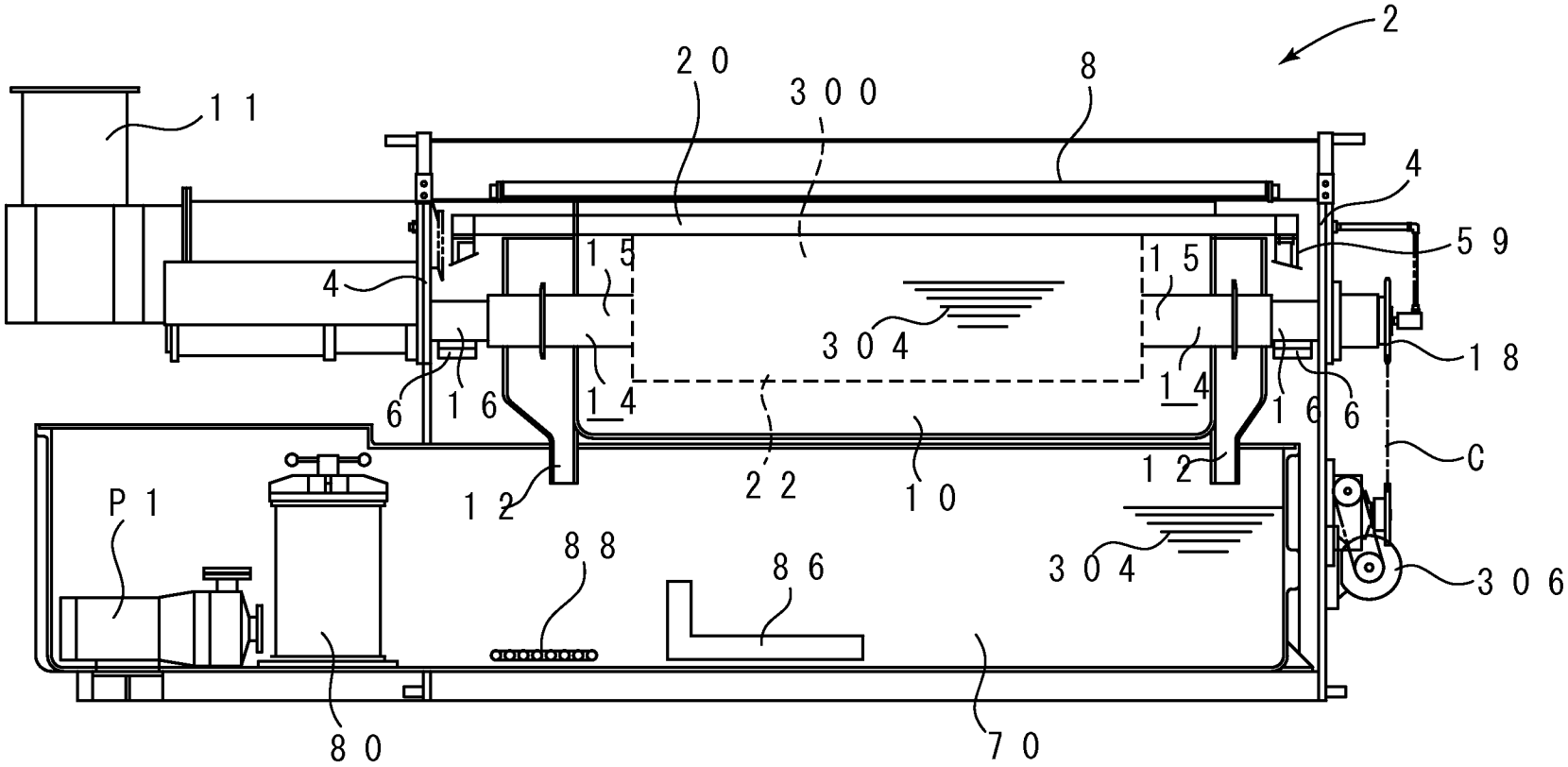
FIG. 3 is a schematic explanatory side view illustrating an example of a basic configuration of the plating apparatus for a cylinder of the present invention.

FIG. 3 is a schematic explanatory side view illustrating an example of a basic configuration of the plating apparatus for a cylinder of the present invention. In FIG. 3, reference symbol 2 denotes a plating apparatus for a cylinder of the present invention, and as a specific illustrated example, a copper plating apparatus for a gravure cylinder is described. The copper plating apparatus 2 for a gravure cylinder of the present invention performs copper plating on the outer peripheral surface of a gravure cylinder 300 in a long hollow cylindrical shape, and includes a plating bath 10, a pair of chuck means 14, 14 for supporting the gravure cylinder 300, and a pair of insoluble electrodes 22, 22 that are vertically installed in the plating bath 10 through use of busbars 20, 20. The plating bath 10 and the chuck means 14 have a regular configuration substantially similar to those of conventional apparatuses (see Patent Documents 1 to 3, 5, and 6), and hence the repeated descriptions thereof are omitted. The plating bath 10 is used for plating treatment, which is filled with a copper plating solution 304 and is capable of soaking the gravure cylinder 300 in the copper plating solution 304 completely. On the periphery of the plating bath 10, a collecting port 12 for collecting the overflowed copper plating solution 304 (see FIGS. 3, 4, and 5) is provided, and below the plating bath 10, a reservoir bath 70 for storing the copper plating solution 304 is provided in communication with the collecting port 12 (see FIG. 3). In the reservoir bath 70, a heater 86 and a heat exchanger 88 for keeping the copper plating solution 304 at a predetermined liquid temperature (e.g., about 40° C.) are provided, and a filter 80 for removing impurities in the copper plating solution 304, a pump P1 for pumping up the copper plating solution 304 from the reservoir bath 70 so that the copper plating liquid 304 circulates to the plating bath 10, and the like are provided (see FIG. 3).

The chuck means 14, 14 are a roll chuck apparatus (see Patent Documents 1 to 3, 5, and 6) for holding the gravure cylinder 300 at both ends in a longitudinal direction and accommodating the gravure cylinder 300 in the plating bath 10, and include a spindle 16 axially supported by a bearing 6, and a water-resistant adapter 15 for preventing entry of the copper plating solution 304. The chuck means 14, 14 are driven to rotate at a predetermined speed (e.g., about 120 rpm) through the intermediation of a chain C and a sprocket 18 by a cylinder rotation motor 306 provided on a base 4, and can be energized so that the gravure cylinder 300 becomes a cathode (see FIG. 3). In addition, a cover plate 8 that can be opened and closed above the plating bath 10, a discharge duct 11, and the like are provided appropriately (see FIG. 3).

Figure 1:
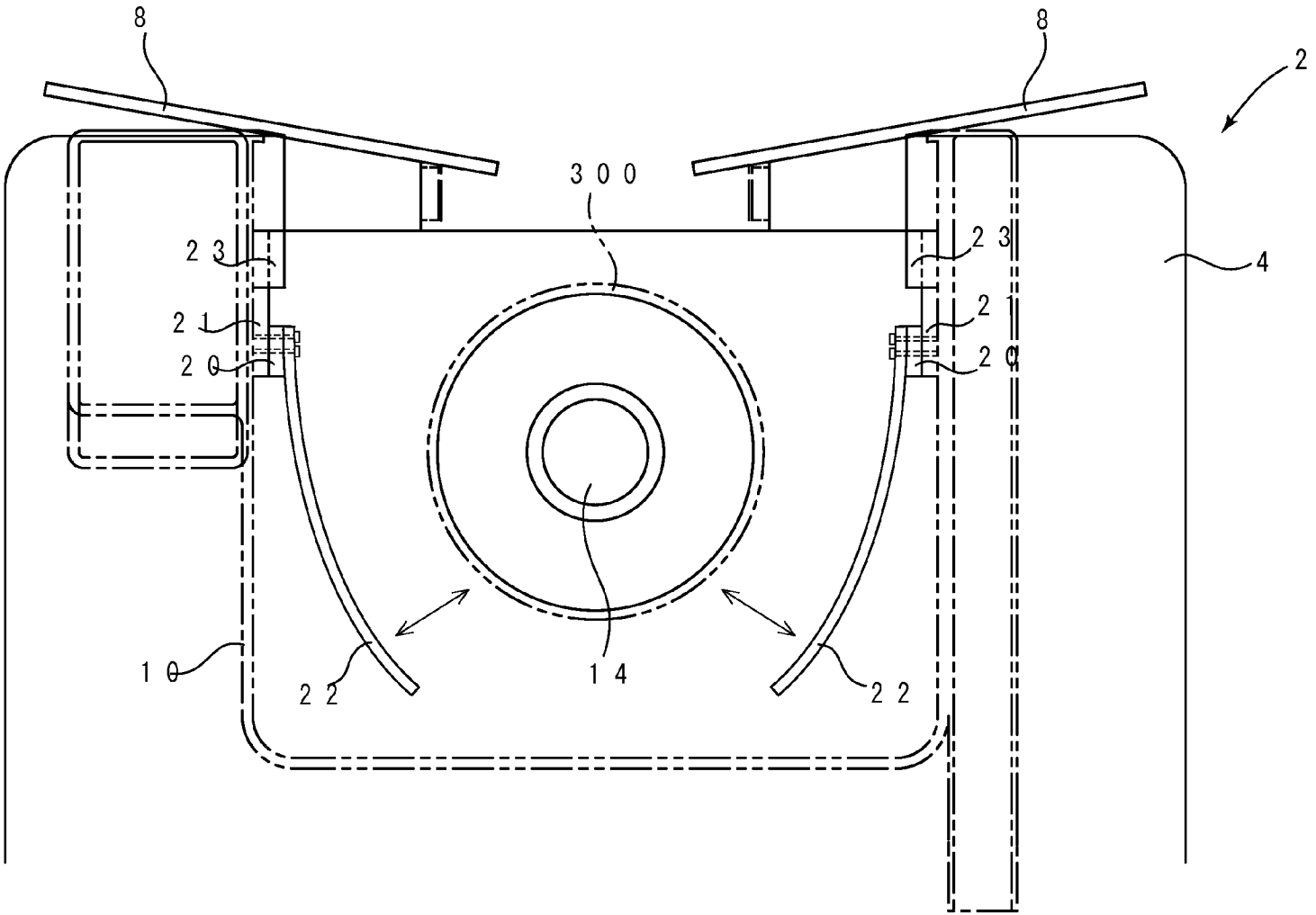
FIG. 1 is a schematic explanatory front view illustrating an example of placing an insoluble electrode in a plating apparatus for a cylinder of the present invention.
Figure 2:
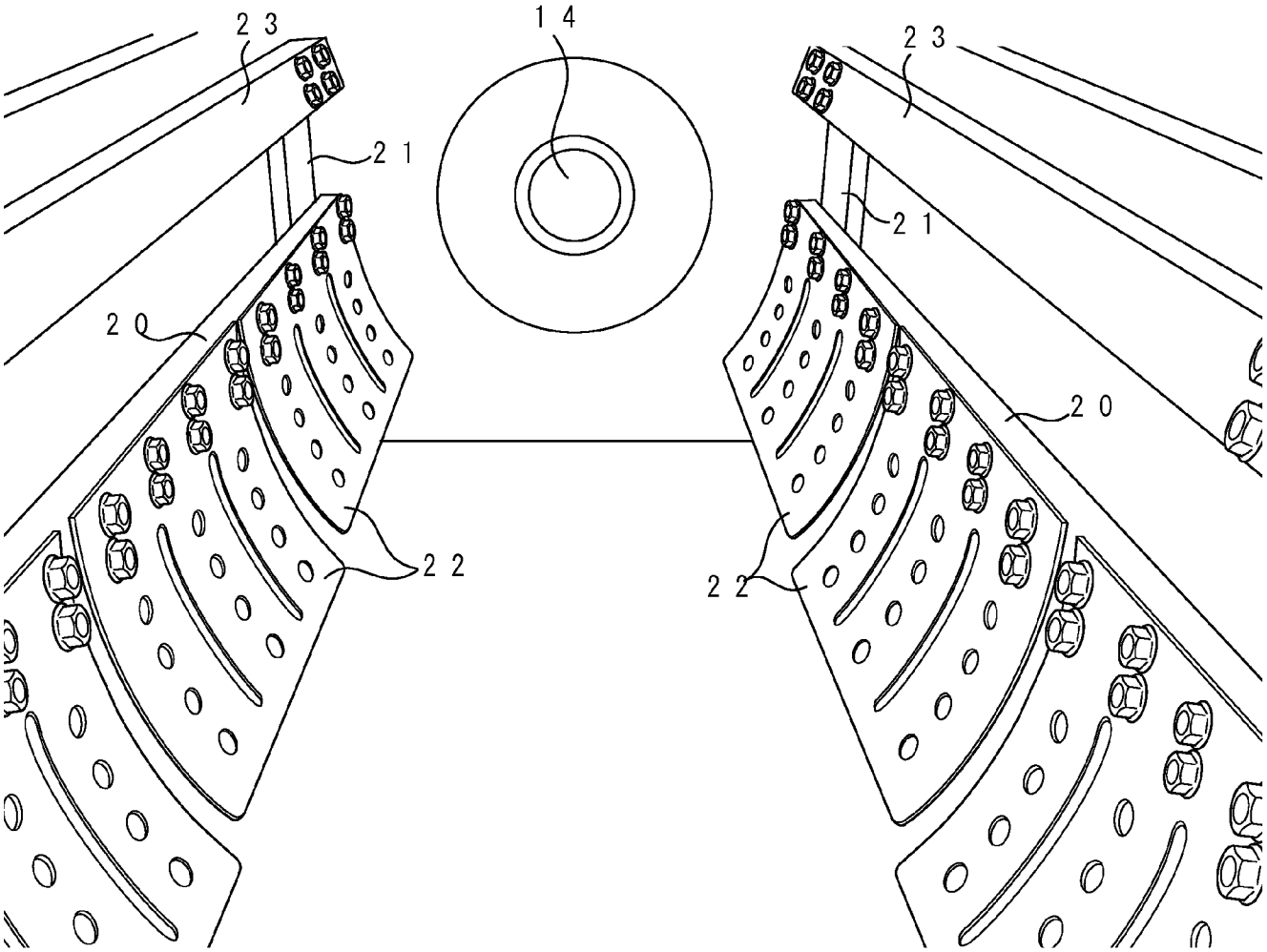
FIG. 2 is a schematic enlarged explanatory perspective view illustrating an example of a mode of placing the insoluble electrode in the plating apparatus for a cylinder of the present invention.

FIG. 1 is a schematic explanatory front view illustrating an example of placing the insoluble electrode in the plating apparatus for a cylinder of the present invention. FIG. 2 is a schematic enlarged explanatory perspective view illustrating main portions of FIG. 1. In the copper plating apparatus 2 for a gravure cylinder of the present invention, as illustrated in FIG. 1, the busbars 20, 20 are fixed to support bars 23, 23 through an intermediation of auxiliary members 21, and the insoluble electrodes 22, 22 are vertically installed to the busbars 20, 20 so as to face respective sides of the gravure cylinder 300 held by the chuck means 14 in the plating bath 10. As the insoluble electrode 22, a titanium plate coated on the surface with iridium oxide or the like is used.

Figure 7:
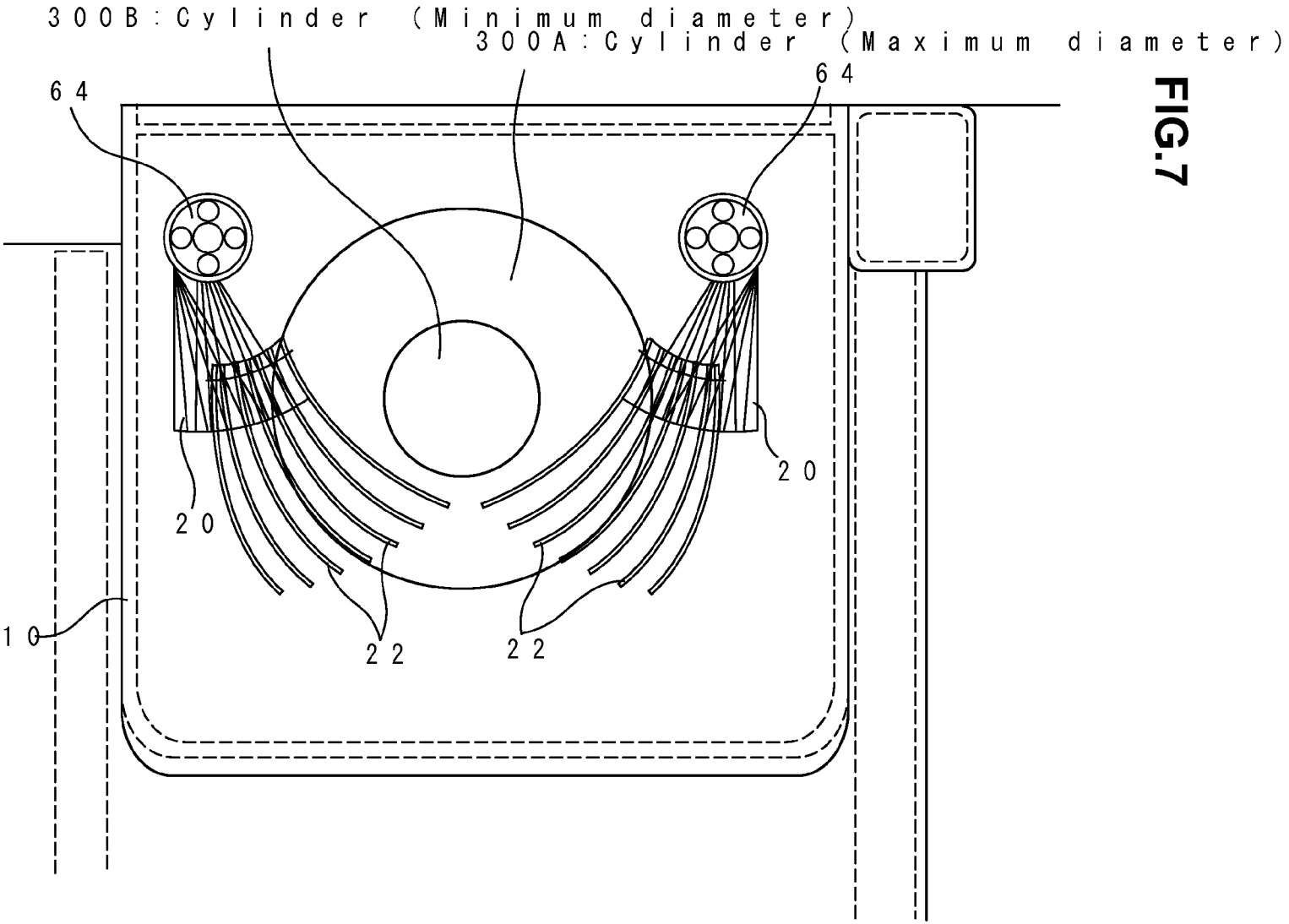
FIG. 7 is an explanatory front view illustrating an operation example of the insoluble electrode in the present invention.

The feature of the present invention resides in that, as clearly illustrated in FIGS. 1, 2, and 7, the insoluble electrodes 22, 22 have a shape in which lower parts thereof are curved inward. Regarding the curved shape of the lower parts of the insoluble electrodes 22, 22, the effect is enhanced as long as the lower parts are curved inward. However, it is preferred that the lower parts have a curved shape so as to conform to the curved outer peripheral surface of the gravure cylinder 300. Further, the insoluble electrodes 22, 22 are configured so as to rotate about upper ends thereof, for example, about rotation shafts 64 provided in the plating bath 10 as specifically illustrated in FIG. 7, and the thickness of the plating layer on the outer peripheral surface of the gravure cylinder can be adjusted by controlling the interval of closeness to the gravure cylinder 300. As a mechanism for allowing the insoluble electrodes 22, 22 to rotate, any well-known rotation mechanism only needs to be adopted. However, for example, a mechanism as illustrated in FIG. 7 can be adopted. FIG. 7 is an explanatory front view illustrating an operation example of the insoluble electrode in the present invention. In FIG. 7, reference symbols 300A and 300B respectively denote a cylinder having a maximum diameter and a cylinder having a minimum diameter virtually. Reference symbol 64 denotes a rotation shaft fixed to the plating bath 10. The busbar 20 is fixed to the rotation shaft 64, and the insoluble electrode 22 is mounted to a tip of the busbar 20. Due to such a configuration, when the rotation shaft 64 is rotated, the busbar 20 rotates, and the insoluble electrode 22 also rotates. Accordingly, as illustrated in FIG. 7, the insoluble electrode 22 is rotated in accordance with the diameter of the cylinders 300, 300A, and 300B, and the distance of closeness of the lower end thereof to the surface of the cylinders 300, 300A, and 300B is controlled to an optimum position, to thereby perform plating.

Figure 4:
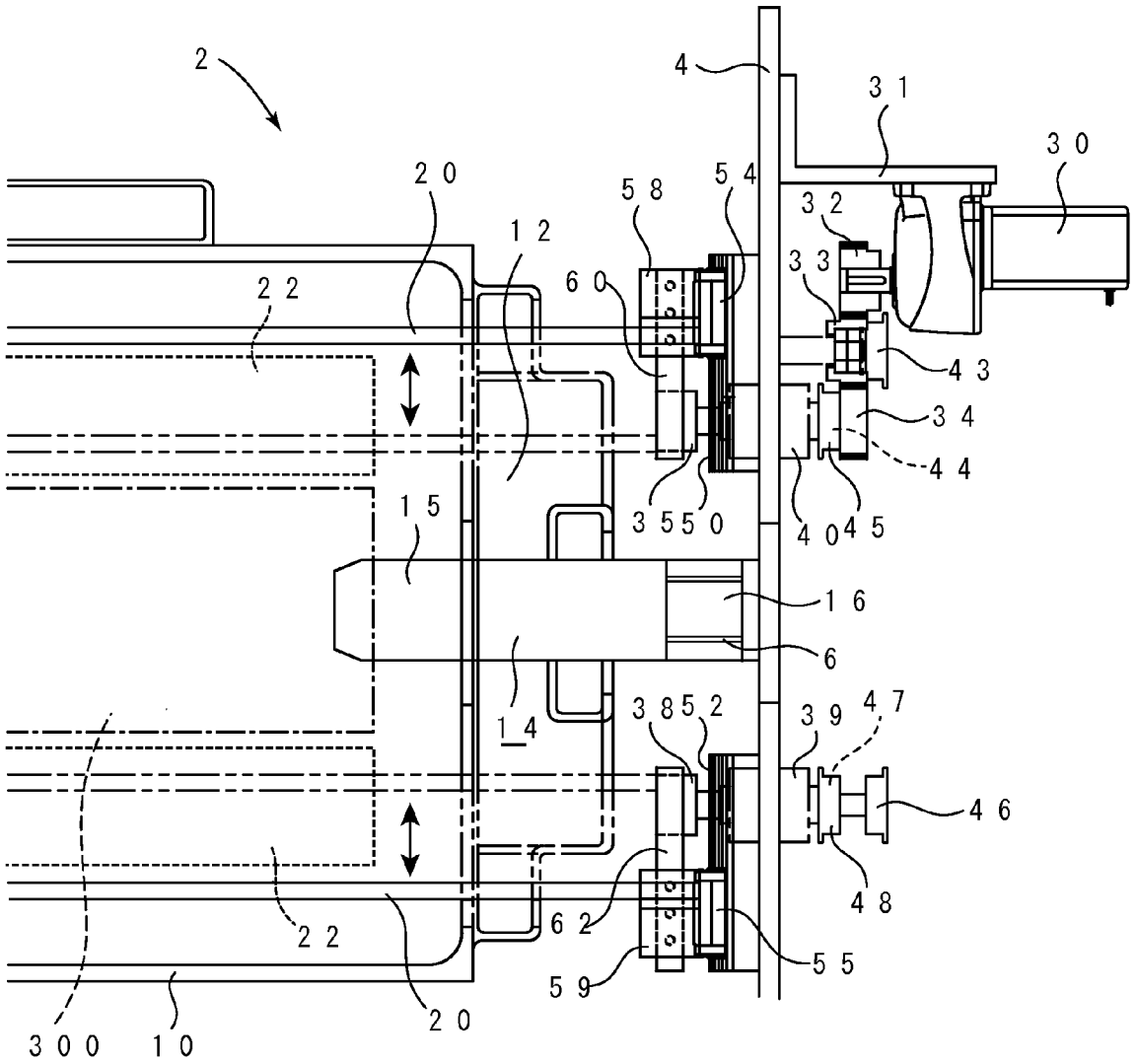
FIG. 4 is an explanatory plan view illustrating an example of a slide mechanism for the insoluble electrode in the present invention.
Figure 5:
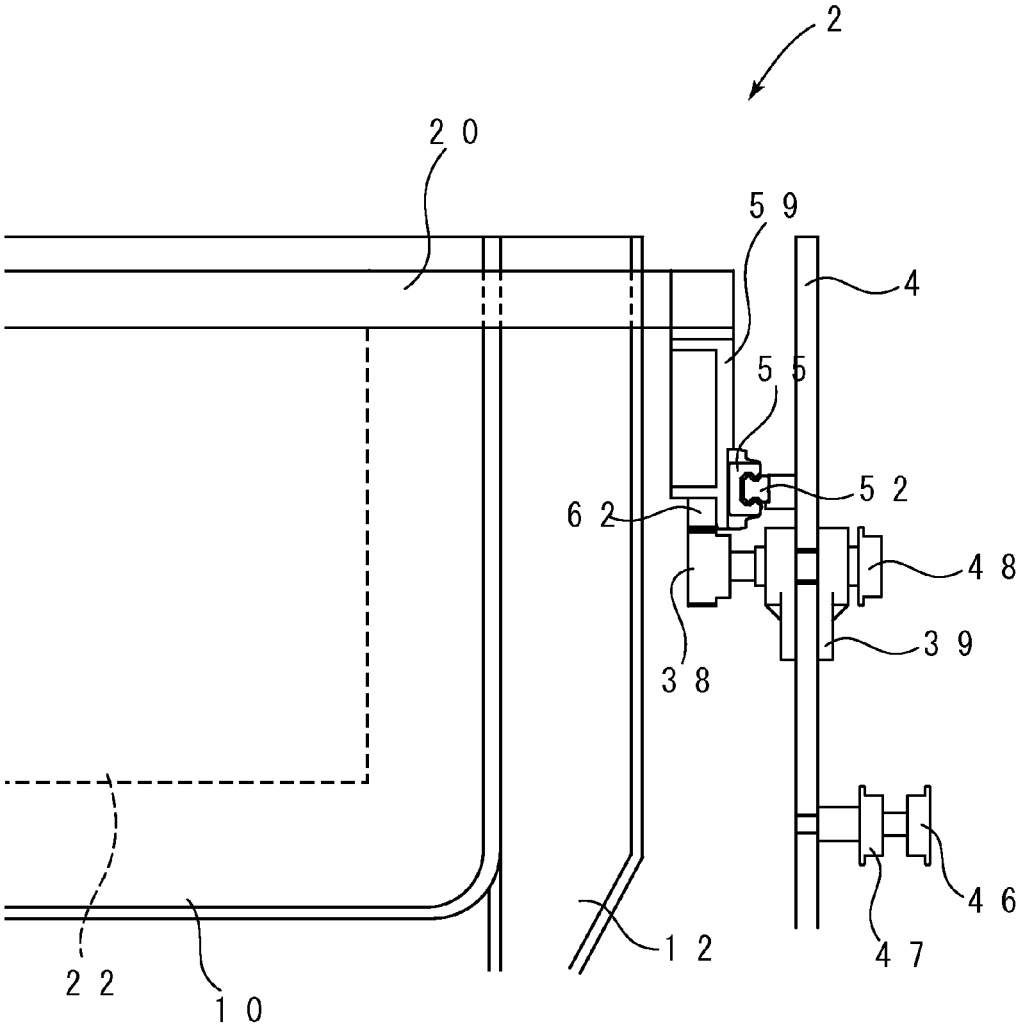
FIG. 5 is an explanatory side view illustrating an example of the slide mechanism for the insoluble electrode in the present invention.
Figure 6:
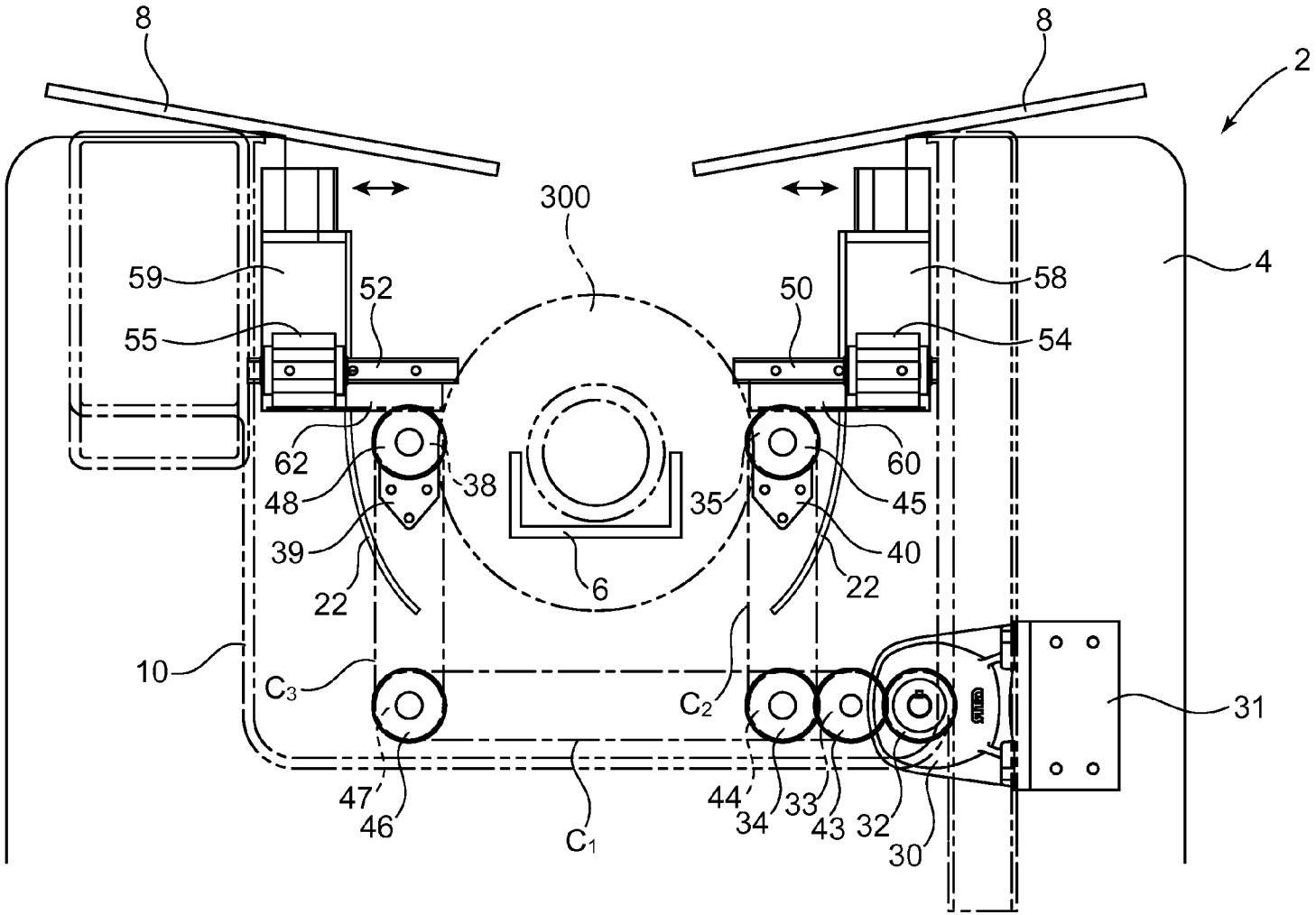
FIG. 6 is an explanatory front view illustrating an example of the slide mechanism for the insoluble electrode in the present invention.

Next, an example of a mechanism that enables the pair of insoluble electrodes 22, 22 to slide on both sides of the gravure cylinder 300, which is not essential in the present invention and is not particularly limited for a structure of the mechanism, is described with reference to FIGS. 4 to 6. FIG. 4 is an explanatory plan view illustrating an example of a slide mechanism for the insoluble electrode in the present invention. FIG. 5 is an explanatory side view illustrating an example of the slide mechanism for the insoluble electrode in the present invention. FIG. 6 is an explanatory front view illustrating an example of the slide mechanism for the insoluble electrode in the present invention. As illustrated in FIGS. 4 to 6, the base 4 is provided upright outside the front surface of the plating bath 10, and linear rails 50, 52 are provided on an inner wall surface of the base 4. Racks 60, 62 are provided so as to reciprocate due to the forward and reverse rotations of spur gears 35, 38 in parallel to the linear rails 50, 52, and are connected to guide members 54, 55 slidably engaged with the linear rails 50, 52 through the intermediation of mounting frames 58, 59.

Regarding the spur gears 35, 38 that allow the racks 60, 62 to reciprocate, the spur gear 35 is fixed to the base 4 with a fixture 40 so as to rotate coaxially with a sprocket 45 on the outer wall surface side of the base 4. On the other hand, the spur gear 38 is fixed to the base 4 with a fixture 39 so as to rotate coaxially with a sprocket 48 on the outer wall surface side of the base 4. Right below the sprocket 45, a sprocket 44 is provided so as to rotate coaxially with a spur gear 34, and right below the other sprocket 48, a sprocket 47 is provided so as to rotate coaxially with a sprocket 46. On the outer wall surface of the base 4, a geared motor 30 is installed through the intermediation of a mounting angle bar 31, and a spur gear 32 is provided. A spur gear 33 is provided so as to rotate coaxially with a sprocket 43 and to be engaged with the spur gear 32. A chain C1 is engaged between the sprockets 43, 46, a chain C2 is engaged between the sprockets 44, 45, and a chain C3 is engaged between the sprockets 47, 48. Thus, due to the forward and reverse drive of the geared motor 30, the spur gears 35, 38 rotate forwardly and reversely, and the racks 60, 62 reciprocate. In synchronization therewith, the insoluble electrodes 22, 22 are slidable accurately along the linear rails 50, 52 (see FIGS. 4 to 6).

The interval at which each insoluble electrodes 22, 22 are brought close to the side surfaces of the gravure cylinder 300 is about 1 mm to 50 mm, preferably about 3 mm to 40 mm, most preferably about 5 mm to 30 mm. From the viewpoint of the uniformity of a plating thickness, it is considered to be preferred that the insoluble electrodes 22, 22 be brought as close to the side surfaces of the gravure cylinder 300 as possible. However, when the insoluble electrodes 22, 22 are brought too close to the side surfaces of the gravure cylinder 300, the insoluble electrodes 22, 22 and the gravure cylinder 300 may come into contact with each other during copper plating treatment.

It is desired that the copper plating apparatus 2 for a gravure cylinder of the present invention further include a copper plating solution automatic management mechanism and a liquid supply mechanism as described in Patent Document 6, but detailed description thereof is omitted.

The above-mentioned copper plating solution automatic management mechanism adjusts the concentrations of copper and sulfuric acid in the copper plating solution stored in the reservoir bath. In the case where the copper plating solution contains, for example, copper sulfate ($CuSO_4.5H_2O$) with a concentration of 200 to 250 g/L, sulfuric acid ($H_2SO_4$) with a concentration of 50 to 70 g/L, chlorine (CL) with a concentration of 50 to 200 ppm, and additives with a concentration of 1 to 10 mL/L such as a brightener and a burn prevention agent, as copper plating with respect to the gravure cylinder proceeds, the concentration of copper ions in the copper plating solution decreases, and free sulfuric acid increases. Thus, the copper plating solution automatic management mechanism is introduced for the purpose of adding cupric oxide (CuO) to effect a reaction: $CuO+H_2SO_4 \rightarrow CuSO_4+H_2O$ to adjust the reduced concentration of copper ions. This is preferred because it is not necessary to perform the conventional periodic maintenance of the copper plating solution and the disposal of a waste liquid.

EXAMPLES

The present invention is described more specifically by way of examples below. It should be noted that these examples are shown for illustrative purposes and should not be interpreted in a limited manner.

In the following Examples 1 to 3, the following common configuration was used. As a copper plating solution, a copper sulfate plating solution was used, which had a copper sulfate concentration of 220 g/L, a sulfuric acid concentration of 60 g/L, and a chlorine concentration of 120 ppm, and contained, as additives, 5 mL/L of "Cosmo RS-MU" (produced and sold by Daiwa Special Chemical Co., Ltd.) and 2 mL/L of "Cosmo RS-1" (produced and sold by Daiwa Special Chemical Co., Ltd.). As powder supplied by the copper plating solution automatic management mechanism, cupric oxide powder "Fusible copper oxide (ES-CuO)" (produced and sold by Tsurumi Soda Co., Ltd.) was used. As an insoluble electrode, an electrode obtained by coating the surface of a titanium plate with iridium oxide was used. The lower end portion of the titanium plate was curved.

Example 1

As a gravure cylinder, a cylindrical base of an aluminum core having a circumference of 500 mm and a full length of 1,100 mm was used. The gravure cylinder was mounted in a plating bath under the condition that both ends of the gravure cylinder were chucked. The lower end portions of insoluble electrodes contained in electrode chambers were brought close to gravure cylinder side surfaces up to an interval of 30 mm with a slide mechanism controlled by a computer, and the copper plating solution was overflowed so that the gravure cylinder was soaked completely. The rotation speed of the gravure cylinder was set to 120 rpm, a liquid temperature was set to 40° C., and a current density was set to 16 $A/dm^2$ (total current of 890 A and voltage of 7 V). As illustrated in FIGS. 1, 2, and 7, electrodes including lower end portions curved inward were used to perform copper plating with a thickness of 100 μm. The time required for plating treatment was about 20 minutes. The end surface shape of the cylinder subjected to the plating treatment was measured by a laser measurement device. There were no rashes and pits on a plating surface, and plating with a uniform thickness was performed over the full length of the gravure cylinder. In particular, the uniformity of the thickness of plating was kept also in both ends of the gravure cylinder, and thus, the vicinity of both ends of the gravure cylinder was prevented greatly from being plated thicker than the body portion.

Example 2

The same result as that of Example 1 was obtained, when plating treatment was performed in the same way as in Example 1 except for using a cylindrical base of an aluminum core having a circumference of 430 mm and a full length of 1,100 mm as a gravure cylinder.

Example 3

The same result as that of Example 1 was obtained, when plating treatment was performed in the same way as in Example 1 except for using a cylindrical base of an aluminum core having a circumference of 920 mm and a full length of 1,100 mm as a gravure cylinder.

In the above-mentioned embodiment of the present invention, an example is described in which copper plating is performed with respect to a gravure cylinder. However, the present invention is not limited to this example. The present invention can also be applied to the case where chromium plating is performed with respect to a gravure cylinder and to the case where plating other than copper plating is performed with respect to other cylindrical objects to be plated. For example, the present invention can be similarly applied to the case where nickel plating is performed with respect to a printing cylinder for rotary screen printing.

REFERENCE SIGNS LIST

2: copper plating apparatus for gravure cylinder, 4: base, 6: bearing, 8: cover plate, 10: plating bath, 11: discharge duct, 12: collecting port, 14: chuck means, 15: water-resistant adapter, 16: spindle, 18: sprocket, 20: busbar, 21: auxiliary member, 22: insoluble electrode, 23: support bar, 30: geared motor, 31: mounting angle bar, 32, 33, 34, 35, 38: spur gear, 39: fixture, 40: fixture, 43, 44, 45, 46, 47, 48: sprocket, 50, 52: linear rail, 54, 55: guide member, 58, 59: mounting frame, 60, 62: rack, 64: rotation shaft, 70: reservoir bath, 80: filter, 86: heater, 88: heat exchanger, 300: gravure cylinder, 304: copper plating solution, 306: cylinder rotation motor, C, C1, C2, C3: chain, P1: pump.

The invention claimed is:

1. A plating method for a cylinder, comprising:

holding a long cylinder at both ends in a longitudinal direction;

accommodating the long cylinder in a plating bath filled with a plating solution;

energizing the long cylinder so that the long cylinder functions as a cathode while rotating the long cylinder at a predetermined speed;

bringing a pair of opposed insoluble electrodes close to both side surfaces of the long cylinder with a predetermined interval, the pair of opposed insoluble electrodes being vertically installed so as to face both the side surfaces of the long cylinder in the plating bath and supplied with a predetermined current; and performing plating on an outer peripheral surface of the long cylinder, the pair of opposed insoluble electrodes having a shape in which a lower part thereof is curved inward, said lower part comprising an upper end, said pair of opposed insoluble electrodes being mounted for movement such that said lower part rotates about said upper end, wherein a thickness of a plating layer on the outer peripheral surface of the long cylinder is adjusted by controlling an interval of closeness to the long cylinder.

2. A plating method for a cylinder according to claim 1, wherein the pair of opposed insoluble electrodes has a curved shape corresponding to a curvature of the outer peripheral surface of the long cylinder.

3. A plating method for a cylinder according to claim 2, wherein the plating solution comprises a copper plating solution or a chromium plating solution, and the long cylinder comprises a hollow cylindrical gravure cylinder.

4. A plating method for a cylinder according to claim 1, wherein the plating solution comprises a copper plating solution or a chromium plating solution, and the long cylinder comprises a hollow cylindrical gravure cylinder.

5. A plating method for a cylinder according to claim 1, wherein said lower part is rotatable about a longitudinal axis of said long cylinder.

6. A plating apparatus for a cylinder, comprising:

a plating bath for receiving a plating solution;

a chuck means for holding a long cylinder at both ends of the long cylinder in a longitudinal direction such that said long cylinder is rotated and energized;

a shaft comprising a longitudinal shaft axis, said shaft being rotatable about said longitudinal shaft axis;

an insoluble electrode comprising an insoluble electrode lower inwardly curved portion, said insoluble electrode being connected to said shaft such that at least said insoluble electrode lower inwardly curved portion rotates relative to said longitudinal shaft axis when said shaft is rotated.

7. A plating apparatus according to claim 6, further comprising:

another shaft;

another insoluble electrode to form a pair of opposed insoluble electrodes, said another insoluble electrode being connected to said another shaft, said another insoluble electrode comprising another insoluble electrode lower inwardly curved portion, said insoluble electrode facing one side surface of the long cylinder in the plating bath and said another insoluble electrode facing another side surface of the long cylinder in the plating bath, said insoluble electrode and said another insoluble electrode being supplied with a predetermined current, said insoluble electrode being rotated via said shaft such that said insoluble electrode lower inwardly curved portion is located adjacent to the one side surface of the long cylinder, said another insoluble electrode being rotated via said another shaft such that said another insoluble electrode inwardly curved lower portion is located adjacent to the another side surface of the long cylinder, said insoluble electrode and said another insoluble electrode performing plating on an outer peripheral surface of the long cylinder, wherein a thickness of a plating layer on the outer peripheral surface of the long cylinder is adjusted by controlling an interval of closeness to the long cylinder.

8. A plating apparatus according to claim 7, wherein at least a portion of the long cylinder is provided in the plating bath.

9. A plating apparatus according to claim 7, wherein at least said another insoluble electrode lower inwardly curved portion being rotatable about a longitudinal axis of the long cylinder via rotation of said another shaft, at least said insoluble electrode lower inwardly curved portion being rotatable about the longitudinal axis of the long cylinder via rotation of said shaft.

10. A plating apparatus according to claim 6, wherein at least said insoluble electrode lower inwardly curved portion is rotatable about a longitudinal axis of the long cylinder via rotation of said shaft.

11. A plating apparatus for a cylinder, comprising:

a plating bath to be filled with a plating solution;

a chuck means for holding a long cylinder at both ends of said long cylinder in a longitudinal direction such that said long cylinder is rotated and energized, and accommodating the long cylinder in the plating bath; and a pair of opposed insoluble electrodes which is vertically installed so as to face both side surfaces of the long cylinder in the plating bath, and is supplied with a predetermined current, the pair of opposed insoluble electrodes being brought close to both the side surfaces of the long cylinder with a predetermined interval to perform plating on an outer peripheral surface of the long cylinder, the pair of opposed insoluble electrodes having a shape in which a lower part thereof is curved inward, said lower part comprising an upper end, said pair of opposed insoluble electrodes being mounted for movement such that said lower part rotates about said upper end, wherein a thickness of a plating layer on the outer peripheral surface of the long cylinder is adjusted by controlling an interval of closeness to the long cylinder.

12. A plating apparatus for a cylinder according to claim 11, wherein the plating solution comprises a copper plating solution or a chromium plating solution, and the long cylinder comprises a hollow cylindrical gravure cylinder.

13. A plating apparatus for a cylinder according to claim 11, wherein the pair of opposed insoluble electrodes has a curved shape corresponding to a curvature of the outer peripheral surface of the long cylinder.

14. A plating apparatus for a cylinder according to claim 13, wherein the plating solution comprises a copper plating solution or a chromium plating solution, and the long cylinder comprises a hollow cylindrical gravure cylinder.

15. A plating apparatus for a cylinder according to claim 13, wherein said lower part is rotatable about a longitudinal axis of said long cylinder.

* * * * *